US006153158A

United States Patent [19]

Flannery et al.

[11] Patent Number: 6,153,158

[45] Date of Patent: Nov. 28, 2000

[54] METHOD AND APPARATUS FOR TREATING GASEOUS EFFLUENTS FROM WASTE TREATMENT SYSTEMS

[75] Inventors: Philip A. Flannery, Ramsey; Stephan T. Kujawa, Butte, both of Mont.

[73] Assignee: MSE Technology Applications, INC, Butte, Mont.

[21] Appl. No.: 09/126,831

[22] Filed: Jul. 31, 1998

[51] Int. Cl.[7] ..... G21F 9/02; A62D 3/00

[52] U.S. Cl. ..... 423/210; 588/1; 588/240; 588/243; 204/157.3; 422/186.21; 422/186.23; 422/186.29; 423/245.3

[58] Field of Search ..... 423/210, 245.3; 588/1, 240, 243; 204/157.3; 422/186.21, 186.23, 186.29

[56] References Cited

U.S. PATENT DOCUMENTS

| | | | |
|---|---|---|---|
| 4,438,706 | 3/1984 | Boday et al. | 588/213 |
| 4,479,443 | 10/1984 | Faldt et al. | 588/210 |
| 5,288,969 | 2/1994 | Wong et al. | 219/121.52 |
| 5,534,659 | 7/1996 | Springer et al. | 204/157.3 |
| 5,611,947 | 3/1997 | Vavruska | 219/121.52 |
| 5,762,009 | 6/1998 | Garrison et al. | 110/346 |

*Primary Examiner*—Tom Dunn
*Assistant Examiner*—Peter DiMauro
*Attorney, Agent, or Firm*—Peter Tribulski

[57] ABSTRACT

Effluents from a waste treatment operation are incinerated and oxidized by passing the gases through an inductively coupled plasmas arc torch. The effluents are transformed into plasma within the torch. At extremely high plasma temperatures, the effluents quickly oxidize. The process results in high temperature oxidation of the gases without addition of any mass flow for introduction of energy.

8 Claims, 3 Drawing Sheets

METHOD AND APPARATUS FOR TREATING GASEOUS EFFLUENTS FROM WASTE TREATMENT SYSTEMS

CONTRACTUAL ORIGIN OF THE INVENTION

This invention was made with United States Government support under Contract No. DE-AC22-88ID12735 awarded by the Department of Energy. The Government has certain rights in this invention.

FIELD OF THE INVENTION

The invention relates to treating industrial wastes.

BACKGROUND OF THE INVENTION

Throughout the industrialized world there are deposits of contaminated soil which pose a hazard. Ground water enters these contaminated soils, dissolves and carries some of the contaminants into drinking water supplies. The contaminants include such materials as harmful organic compounds and soluble heavy metals. In some cases the soils are contaminated with radioactive wastes.

In some serious cases, contaminated soils are removed and treated in furnaces to produce vitrified masses of material. When contaminated soil is vitrified, its density is increased and its volume is reduced. Additionally, organic compounds are typically incinerated and rendered harmless. When a mass of contaminated soil is vitrified, it can be safely buried in the earth because any heavy metal components of the soil are made substantially unleachable in ground water.

In addition to contaminated soils, there are other hazardous objects which require safe disposal. For, example obsolete military devices such as fuses and chemical warfare apparatus need to be destroyed in a cost-effective way. In many of these cases, for purposes of maintaining secrecy, there is a need to obliterate any discernible features or characteristics of the devices. Disposal of such devices in a vitrified soil medium has been found to be technically and economically viable.

Another area of waste treatment involves pyrolysis of certain small quantities of radioactive materials. In these cases, it is desirable to avoid transporting the radioactive materials to a waste treatment facility. Instead, it is useful to provide a portable waste treatment unit which can be transported to the location of the radioactive material. This, of course requires that such waste treatment equipment be compact and readily transportable. Ideally such a treatment unit might have a glove-box configuration.

Whenever these waste vitrification, incineration and pyrolysis methods are practiced, a quantity of complex gaseous effluents are produced. These effluents cannot simply be released to the atmosphere. They must be reduced into more simple components and then treated to eliminate any possible toxicity. Typically, the conversion of a complex effluent into simple treatable components requires addition of energy to the effluent. In other words, the effluent must be incinerated and oxidized.

Ironically, whenever a complex effluent is oxidized, there has heretofore been a need to add a certain mass of energy bearing material to the effluent stream. Typically, this energy bearing material is a combustible mixture such as propane or natural gas and oxygen. This results in a need to treat a greater mass of gas than that which emerges as the original effluent.

Treatment of gases that are the products of an effluent oxidization process is costly. It is desirable therefore to develop a process in which the quantities of gases needing treatment are held to a minimum.

Some prior art methods have been directed toward that goal. For example, some systems have employed plasma arc torches as a source of energy to accomplish incineration of effluent without producing additional products of combustion.

In this type of system a plasma gas such as argon or oxygen is passed through a plasma arc torch and injected at very high temperature into a stream of effluent. Heat is transferred to the effluent stream from the heated plasma gas and the temperature of the effluent rises accordingly. These plasma arc systems have some obvious advantages over fuel based incineration systems in that a lower mass of material needs to be introduced into the effluent stream. This, of course, means that a lower mass of incinerated and oxidized gas needs to be treated to eliminate toxicity. One example of these prior art systems is described in Proceedings of the International Topical Meeting on Nuclear and Hazardous Waste Management Spectrum '96, Aug. 18–23, 1996 in a paper entitled "The PERC Process: Existing and Potential Applications for Induction Coupled Plasma Technology in Hazardous and Radioactive Waste Treatment", presented by A. S. Blutke, J. S. Vavruska and J. F. Serino.

However, even these improved prior art plasma arc systems add mass to the effluent stream. The argon or oxygen or other plasma gas is introduced into the effluent stream and increases its mass.

It is a goal of the present invention to provide a method of adding energy to an effluent stream in a manner which will produce a desired incineration and oxidation of the effluent while not adding to its mass.

It is a further goal of the present invention to provide such a method which can be practiced with apparatus which is compact and inexpensive.

SUMMARY OF THE INVENTION

The present invention is directed to a method and apparatus for treating waste materials in which effluents are produced. The effluents are passed through an inductively coupled plasma torch to produce a plasma from the effluents whereby the effluents are oxidized very rapidly. There is no mass added to the effluents in order to raise their temperature to achieve full oxidation.

The invention will be better understood from the following detailed description taken in consideration with the accompanying drawings and claims.

The drawings are not necessarily to scale.

DETAILED DESCRIPTION

Figure 1:
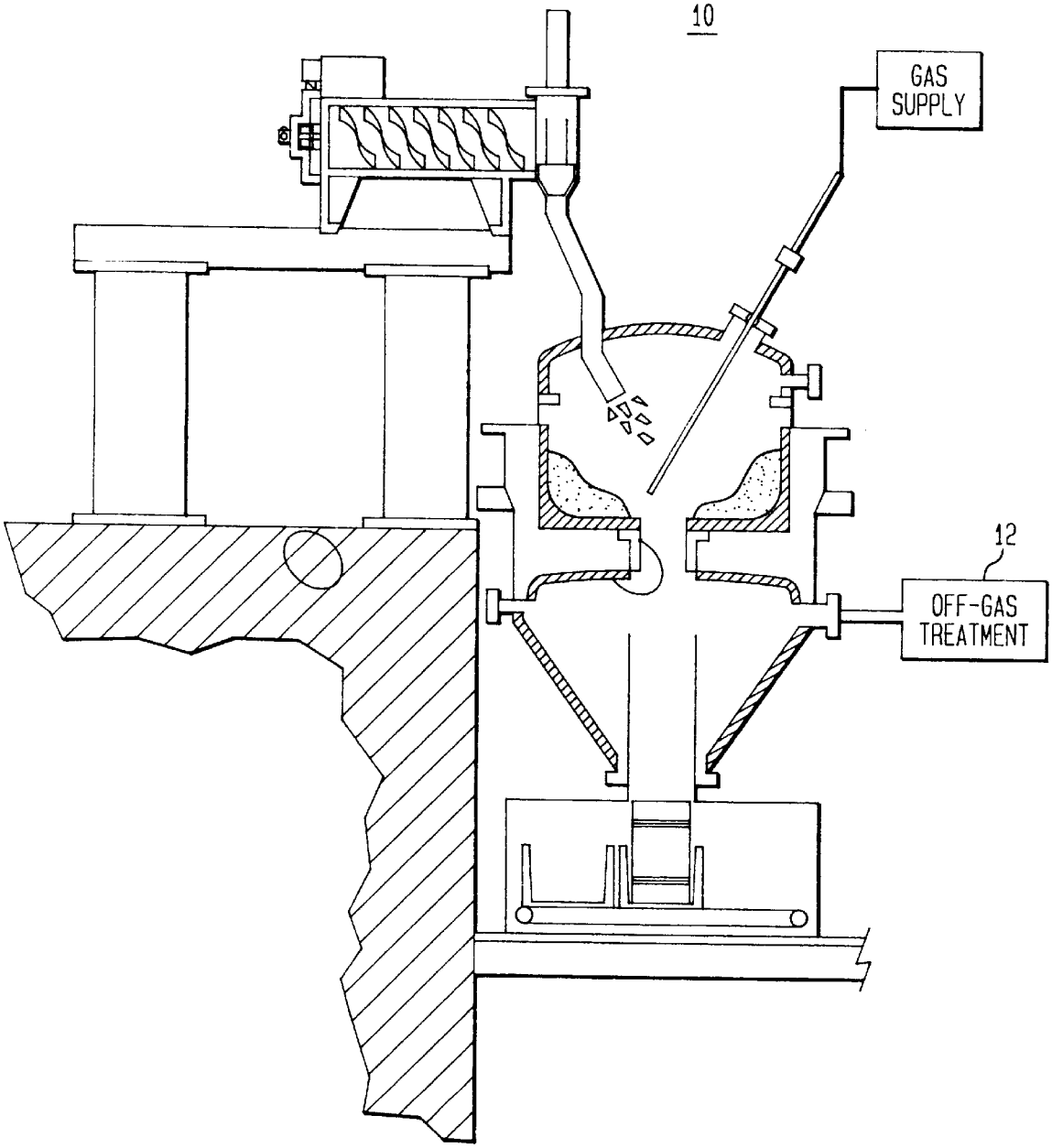
FIG. 1 shows, symbolically, a waste treatment unit in which the present inventive method has utility.

Referring now to FIG. 1, there is shown a waste treatment unit 10 in which the present invention has utility. The unit 10 is used to vitrify waste using heat from a plasma arc torch and injected oxygen. Many of the details of operation and structure of the unit 10 are described in U.S. Pat. No. 5,731,564, Method Of Operating A Centrifugal Plasma Arc Furnace (S. T. Kujawa, et al.), which is incorporated by reference herein.

It will be noted that the unit 10 has an off-gas treatment unit or afterburner 12 which is shown schematically in FIG. 1. The unit 10 differs from the above-mentioned prior art plasma arc furnace in that the afterburner 12 is actually a plasma arc torch. In the prior art unit, off-gas treatment is performed by heating off-gases through combustion of natural gas. The prior art afterburner is a chamber which is four feet in diameter and ten feet in length. The natural gas and oxygen needed for incineration energy produces a doubling of mass of off-gas that needs treatment after emerging from this prior art afterburner.

Figure 2:
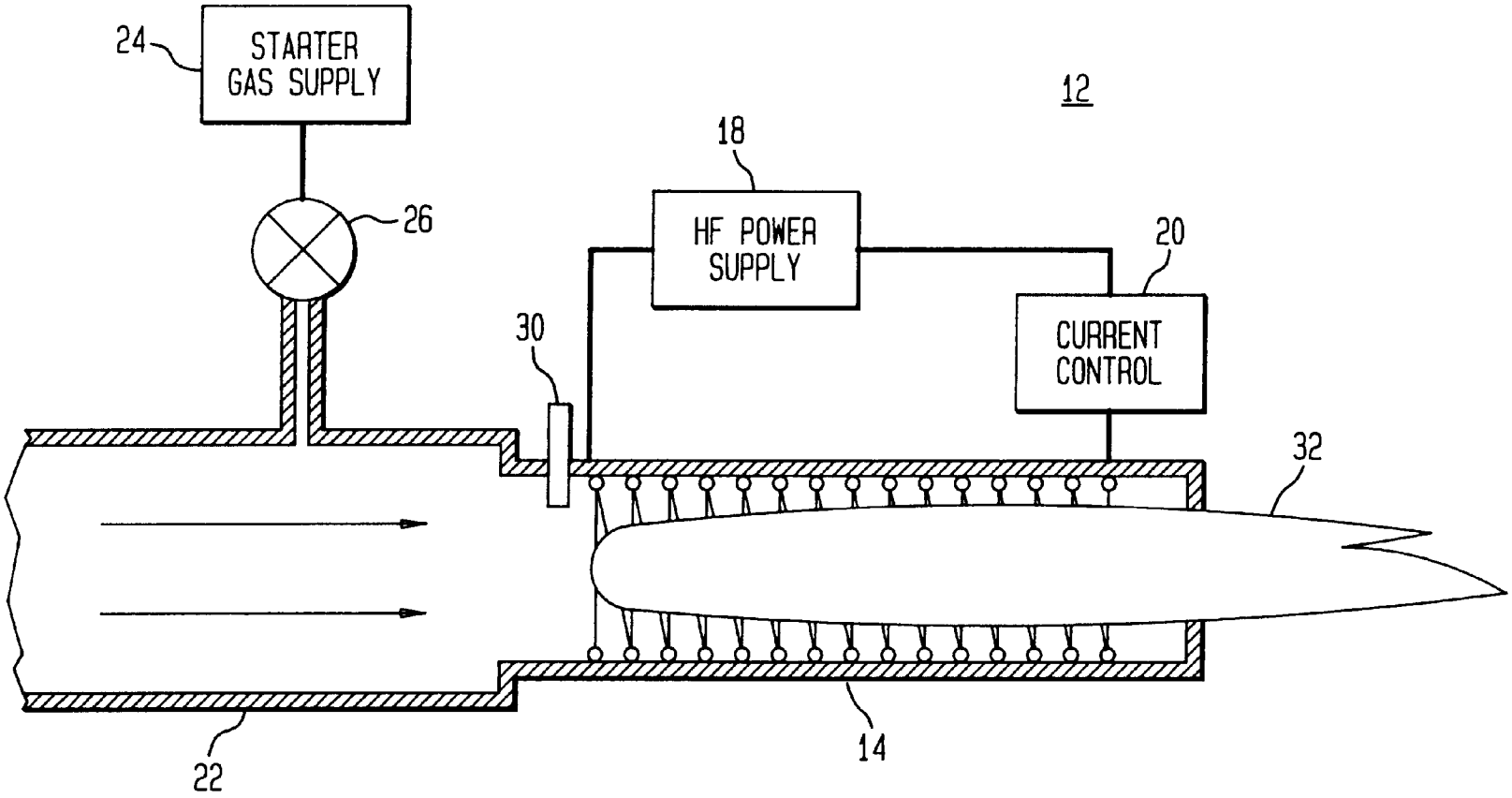
FIG. 2 is a sectional schematic view of an afterburner constructed in accordance with the present invention.

Referring now to FIG. 2 there is shown a cross-sectional view of the inventive afterburner 12 of FIG. 1. The afterburner 12 comprises a chamber 14, an induction coil 16, a high-frequency power supply 18 and a current control unit 20, an off-gas inlet 22, a starter gas supply 24, a control valve 26 and an igniter 30.

In operation, a plasma arc 32 is initiated in the afterburner 12 by passing a starter gas, such as argon through the induction coil while applying a high frequency current through windings of the coil 16. At coil frequencies in the order of three to five MHz the argon forms a sustained plasma arc.

After a sustained argon arc is established in the afterburner 12, a purging stream of clean air or oxygen is introduced into the waste treatment unit 10 of FIG. 1. This clean gas stream passes into the afterburner 12 where it mixes with the argon and enters into the plasma arc 32. As the clean gas from the unit 10 reaches the afterburner 12, the frequency of current through the coil 16 is increased to a range of between 5 to 10 MHz. After the higher frequency is established, the valve 26 is closed and the plasma arc 32 is then sustained with a gas flow consisting only of the clean gas emerging from the waste treatment unit 10.

With a sustained clean gas plasma arc in place in the afterburner 12, the flow rate of clean gas is established to simulate a flow rate that is expected when the waste treatment unit 10 is actively producing contaminated off-gases. The current control 20 is adjusted to a level that produces an arc temperature of 7000 to 10,000° K. at that established clean gas flow rate.

At this point in its operation, the afterburner 12 is ready for introduction of contaminated off-gases. Waste materials are then introduced into the waste treatment unit 10. This produces contaminated off-gasses. These contaminated off-gases pass into the afterburner 12 and become the plasma gas on which the plasma arc 32 is sustained. Since a large portion of the off-gas is oxygen, the plasma arc 32 in the afterburner 12 is readily sustainable with only minor adjustments of frequency and current.

We have found that an inductively coupled torch with an diameter of only about three inches and a length of only about two feet is suitable to incinerate all of the effluents of this waste treatment operation. An afterburner of this size is capable of treating about 20 pounds per minute of contaminated off-gas.

As compared with the prior art, capital costs and operating costs of this type of waste treatment facility are substantially reduced. In prior art systems, a residence time of at least two seconds is required to treat off-gasses. This is because temperature in prior art afterburners typically do not exceed 1000° C. In the present inventive afterburner 12, temperature within the arc 32 exceeds 7000° C. and residence time required for full treatment is reduced to a few microseconds.

Figure 3:
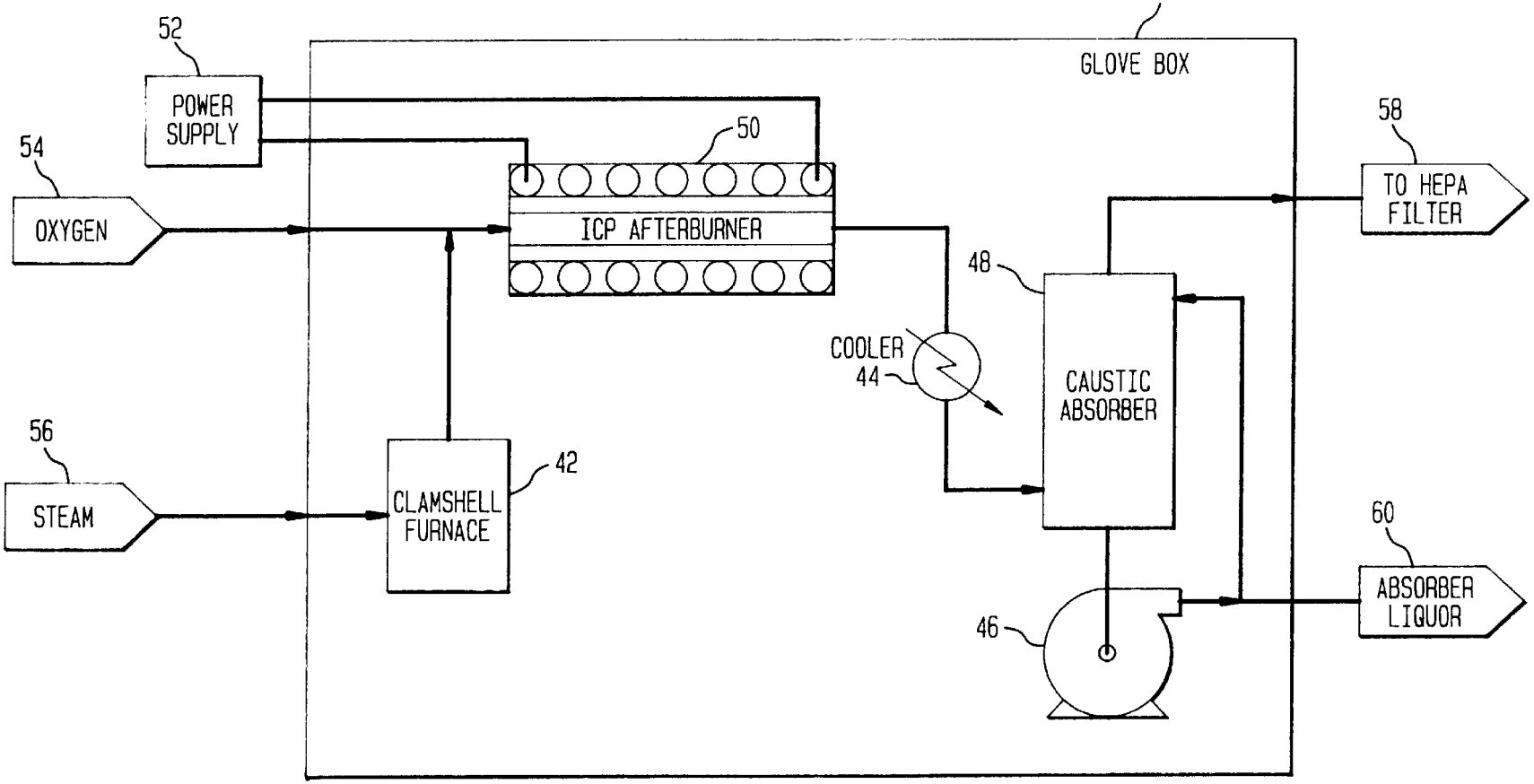
FIG. 3 is a schematic drawing of a waste treatment unit in which the present invention has utility.

Referring now to FIG. 3, there is shown a schematic diagram of another waste treatment system in which the present invention has utility. A glove box waste treatment unit 40 comprises a conventional clamshell furnace 42, a gas cooler 44, a pump 46, a caustic absorber 48 and an inductively coupled plasma afterburner 50. Exterior to the unit 40, there is a power supply 52 for the afterburner 50, an oxygen source 54, a steam source 56, a HEPA filter bank 58 and a collector for absorber liquor 60.

The unit 40 is a pyrolysis reactor used for glove-box waste destruction. The unit 40 processes organic wastes in a reducing environment. A pyrolytic reaction takes place within the clamshell furnace 42 which is supplied with steam from the steam source 56. Typical products of the pyrolytic react ion are light oils, acid gases and high molecular weight carbonaceous residues.

The pyrolysis products are vented into the afterburner 50 along with sufficient oxygen from the oxygen source 54 to assure that the products can completely oxidize. The afterburner 50 is an inductively coupled plasma torch which is powered by the power supply 52.

Within the afterburner 50, inductively coupled energy, the pyrolysis products and the oxygen act together to form a plasma. Energy is introduced by inductive coupling from the power supply 52. The plasma generation results in extremely high temperatures. Temperatures generated within the afterburner 50 are approximately 7000–10,00° K. At these extremely high temperatures, complete oxidation of the pyrolysis products occurs very quickly. Indeed, we have found that residence times in the order of microseconds are sufficient to achieve complete oxidation.

The oxidation products from the afterburner 50 are carbon dioxide, trace quantities of carbon monoxide, hydrogen chloride, sulfur dioxide and trioxide, nitrogen oxides and water vapor. These oxidation products pass through the cooler 44 which reduces their temperature to about 150° C. The cooled oxidation products then enter the caustic absorber 18 which, in a conventional manner, absorbs acid gases and condenses water vapor. Output from the glove-box unit 10 is non-acid gas which goes to the conventional HEPA filter 28 and absorber liquor which goes to the conventional collector 30.

It is important to realize that no additional mass of material is introduced to the pyrolysis products beyond the oxygen needed to fully oxidize these products. In other words, no mass associated with energy introduction is added to the pyrolysis products.

Because of this unique feature of the present invention, the resultant mass of waste material which is transferred to the caustic absorber is held to an absolute minimum.

It is also important to note that because the residence time of pyrolysis products is only in the order of a few microseconds, the afterburner 50 can be quite small. Indeed it is because of the small size of the afterburner 50 that this method of waste destruction can be conducted in a glove-box setting.

Glove-box waste disposal systems are especially useful when radioactive waste materials are to be treated. In these cases, it is often necessary to operate on small batches of material. It is also important that the waste treatment unit 40 can be taken to the site of the waste in order to avoid a need to transport radioactive waste.

Use of an extremely small inductively coupled torch as the afterburner 50 is a key element in being able to perform these waste treatment operations in a small scale glove-box type of operation.

In each of these applications of the inventive method of treating effluent, energy is introduced to the process without a need to add any mass for energy input. This concept is quite remarkable when one considers an analysis that determines how much mass and energy must be introduced into a prior-art effluent treatment system to achieve a desired result. Typically, in this type of analysis it is necessary to determine how to get a particular mass flow of effluent to a desired temperature in order to assure that complete oxidation will occur. The equation for this analysis is as follows:

$$M_H \times Cp_H(T_H - T_{ref}) + M_E \times Cp_E(T_E - T_{ref}) = M_M \times Cp_M(T_M - T_{ref})$$

where:

$M_H$ is the mass of a heating medium;

$Cp_H$ is the specific heat of a heating medium;

$T_H$ is the temperature of a heating medium;

$T_{ref}$ is a reference temperature of 30° C.;

$M_E$ is the mass of the effluent;

$Cp_E$ is the specific heat of the effluent;

$T_E$ is the incoming temperature of the effluent;

$M_M$ is the mass of the mixture of the effluent and the heating medium;

$Cp_M$ is the specific heat of the mixture; and $T_M$ is the desired temperature of the mixture that assures complete oxidation.

Assurance of complete oxidation requires that $T_M$ be at least 1000° C. When the above analysis is applied to prior art systems, it can be seen that in order for $M_H$ to approach or equal zero, then $T_H$ would need to approach or equal infinity. As practical matter, prior art heat sources are capable of producing temperatures no greater than about 10,0000° C. Consequently, this analysis of the prior art would lead one to believe it impossible to produce a system in which $M_H$ is zero. The present invention provides for a system which operates in complete contradiction to this conventional wisdom. In the present system $M_H$ is indeed zero. In other words, there is no addition of mass of a heating medium.

It is to be appreciated and understood that the specific embodiments of the invention are merely illustrative of the general principles of the invention. Various modifications may be made by those skilled in the art which are consistent with the principles set forth.

What is claimed is:

1. A method for performing a waste treatment process to reduce the toxicity of treated materials in which process effluents containing oxygen and toxic gaseous substances are produced as a by-product of the process, the method comprising the step of:

passing the effluents through an inductively coupled plasma torch to produce a plasma from the effluents, whereby the effluents are oxidized.

2. The method of claim 1 wherein the effluents are heated to oxidization temperatures exclusively through introduction of energy that occurs without addition of mass.

3. A method of treating waste materials in a reaction chamber which method produces off-gases that require treatment before release to the atmosphere, the method comprising the steps of:

initiating a plasma arc in an inductively coupled plasma arc torch with a starter gas;

introducing a continuous flow of oxygen-bearing treatment gas into the reaction chamber prior to introduction of waste materials into the chamber;

directing the treatment gas to the plasma arc torch so that the treatment gas passes through the torch;

adjusting operating parameters of the plasma arc torch to produce a sustained arc with the treatment gas flowing therethrough;

introducing waste materials into the reaction chamber after the treatment gas is producing a sustained arc in the plasma arc torch; and passing off-gases from the waste treatment operation through the plasma arc torch so that the off-gases are converted to a plasma within the torch and are thoroughly oxidized.

4. Apparatus for performing a waste treatment process to reduce the toxicity of treated materials in which process effluents containing oxygen and toxic gaseous substances are produced as a by-product of the process, which apparatus comprises:

means for passing the effluents through an inductively coupled plasma torch to produce a plasma from the effluents, whereby the effluents are oxidized.

5. Apparatus for treating waste materials in a reaction chamber wherein off-gases are produced, which off-gasses require treatment before release to the atmosphere, the apparatus comprising:

an inductively coupled plasma arc torch;

means for initiating a plasma arc in the inductively coupled plasma arc torch with a starter gas;

means for introducing a continuous flow of oxygen-bearing treatment gas into the reaction chamber prior to introduction of waste materials into the chamber;

means for directing the treatment gas to the plasma arc torch so that the treatment gas passes through the torch;

means for adjusting operating parameters of the plasma arc torch to produce a sustained arc with the treatment gas flowing therethrough;

means for introducing waste materials into the reaction chamber after the treatment gas is producing a sustained arc in the plasma arc torch; and means for passing the off-gases from the waste treatment operation through the plasma arc torch so that the off-gases are converted to a plasma and are thoroughly oxidized.

6. The apparatus of claim 5 wherein the apparatus is contained in a glove-box.

7. The apparatus of claim 6 wherein waste treatment is performed in the presence of steam.

8. The apparatus of claim 5 wherein the apparatus is portable and can be transported to locations requiring treatment of radioactive waste.

* * * * *